United States Patent [19]

Bott

[11] 4,204,552

[45] May 27, 1980

[54] DUAL SPEED FLUID CONTROL APPARATUS

[75] Inventor: John P. Bott, San Diego, Calif.

[73] Assignee: The United States of America as represented by the Secretary of the Navy, Washington, D.C.

[21] Appl. No.: 954,263

[22] Filed: Oct. 24, 1978

[51] Int. Cl.[2] ..... G05D 16/00

[52] U.S. Cl. ..... 137/81 A; 137/115; 137/599

[58] Field of Search ..... 137/81, 115, 599

[56] References Cited

U.S. PATENT DOCUMENTS 3,327,760 6/1967 Crawford ..... 137/115 X

*Primary Examiner*—Gerald A. Michalsky

*Attorney, Agent, or Firm*—Richard S. Sciascia; Ervin F. Johnston

[57] ABSTRACT

A dual speed fluid control apparatus is provided which includes a valve body having a high pressure passageway and a low pressure passageway extending vertically therethrough in a spaced apart relationship. A top portion of the passageways is interconnected by a top plenum, a middle portion of the passageways is interconnected by a middle plenum, and a bottom portion of the passageways is interconnected by a bottom plenum. The valve body has the following: an ambient pressure inlet into the top plenum, a fluid bypass outlet into the middle plenum, and a pressurized fluid inlet and fluid outlet into the bottom plenum. A valve is located within each passageway and is responsive to pressure in the bottom plenum for bypassing fluid from the bottom plenum to the middle plenum. A spring biased device is located in each passageway and is responsive to the ambient pressure in the top plenum for pushing each valve toward the closed position against the pressure in the bottom plenum. The spring bias on the push device in the high pressure passageway is greater than the spring bias on the push device in the low pressure passageway. A control valve device is provided for selectively opening and closing the bottom portion of the low pressure passage way to the bottom plenum. With this arrangement the fluid control apparatus will supply high pressure fluid when the control valve means is closed and will supply low pressure fluid when the control valve means is open, both of these pressures and flow rates being varied by the magnitude of the ambient pressure in the top plenum.

13 Claims, 8 Drawing Figures

DUAL SPEED FLUID CONTROL APPARATUS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The performance requirements of one of the torpedoes utilized by the U.S. Navy made a selectable two speed operation desirable. Where submarine targets are relatively quiet a slow speed is desired for acoustic search to minimize propulsion generated background noise and enhanced submarine target acoustic returns. After the submarine has been found by the torpedo, a higher torpedo speed is desired to enhance the closure rate. The dual speed mode of the torpedo can be accomplished by a fluid control apparatus which will feed a low rate of fuel to the torpedo motor during slow speed operation and will feed a higher rate of fuel to the torpedo motor when high speed operation is required.

SUMMARY OF THE INVENTION

The present invention provides a fluid control apparatus which will accomplish the dual speed operation of a motor, such as the motor of a torpedo. The dual speed fluid control apparatus may include a valve body which has a high pressure passageway and a low pressure passageway which extend vertically through the valve body in a spaced apart relationship. A top portion of the passageways is interconnected by a top plenum, a middle portion of the passageways is interconnected by a middle plenum, and a bottom portion of the passageways is interconnected by a bottom plenum. The valve body has the following: an ambient pressure inlet into the top plenum, a fluid bypass outlet into the middle plenum, and a pressurized fluid inlet and fluid outlet into the bottom plenum. A valve is located within each passageway and is responsive to pressure in the bottom plenum for bypassing fluid from the bottom plenum to the middle plenum. A spring biased device is located in each passageway and is responsive to the ambient pressure in the top plenum for pushing each valve means toward the closed position against the pressure in the bottom plenum. The spring bias on the push means in the high pressure passageway is greater than the spring bias on the push means in the low pressure passageway. A control valve device is provided for selectively opening and closing the bottom portion of the low pressure passageway to the bottom plenum. With this arrangement the fluid control apparatus supplies high pressure fluid when the control valve means is closed and supplies low pressure fluid when the control valve means is open, both pressures being varied by the magnitude of ambient pressure in the top plenum. The present fluid control apparatus can be utilized for any purposes where high and low fluid rates and/or pressures are required.

OBJECTS OF THE INVENTION

An object of the present invention is to provide a simple and efficient fluid control apparatus which can be selectively operated to supply either a high rate or a low rate of fluid.

Another object is to provide a fluid control apparatus which has a control valve device which, when closed, will cause the apparatus to supply high pressure fluid, and, when open, will cause the apparatus to supply low pressure fluid.

A further object is to provide a fluid control apparatus as stated in the preceding object, but in addition being capable of having both pressures varied by the magnitude of ambient pressure outside the apparatus.

These and other objects of the invention will become more readily apparent from the ensuing specification when taken together with the drawings.

DESCRIPTION OF THE PREFERRED EMBODIMENTS

Figure 1:
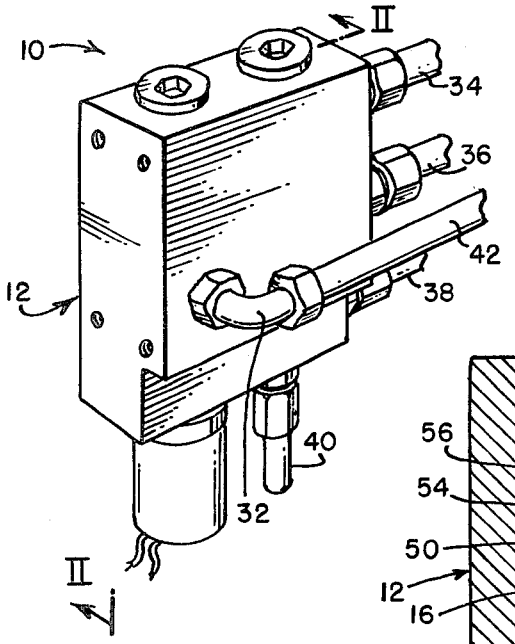
FIG. 1 is an isometric view of an exemplary dual speed fuel control apparatus.
Figure 2:
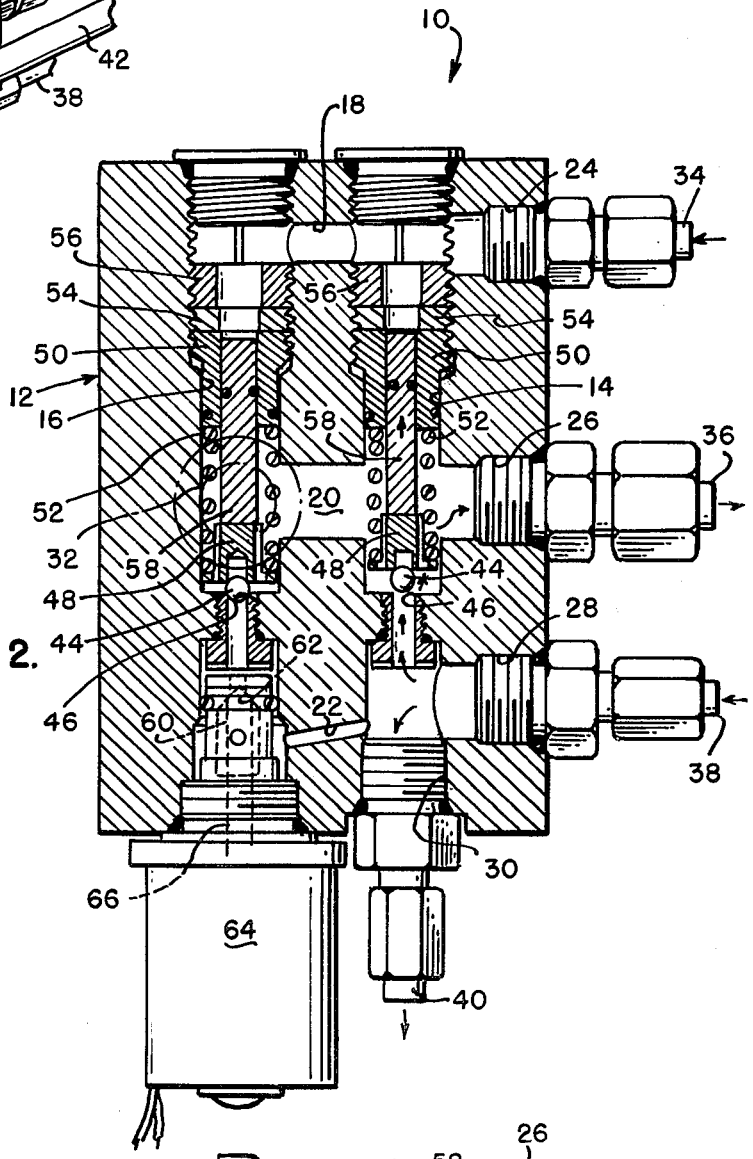
FIG. 2 is a view taken along plane II—II of FIG. 1 illustrating the fluid control apparatus in a high speed mode of operation.

Referring now to the drawings wherein like reference numerals designate like or similar parts throughout the several views, there is illustrated in FIG. 1 a dual speed fluid control apparatus 10, the details of which can best be understood by reference to FIG. 2. The fluid control apparatus 10 includes a valve body 12 which has a high pressure passageway 14 and a low pressure passageway 16 extending vertically through the valve body in a spaced apart relationship. A top portion of the passageways is interconnected by a top plenum 18, a middle portion of the passageways is interconnected by a middle plenum 20, and a bottom portion of the passageways is interconnected by a bottom plenum 22. The valve body has the following (1) an ambient pressure inlet 24 into the top plenum 18, (2) a fluid bypass outlet 26 into the middle plenum 20, and (3) a pressurized fluid inlet 28 and a fluid outlet 30 into the bottom plenum. Optionally the fluid body 12 may have a fluid supply inlet 32 into the plenum 20. The following lines may be connected to the various inlets and outlets: an ambient pressure line 34 to the inlet 24, a fluid bypass line 36 to the outlet 26, a pressurized fluid inlet line 38 to the inlet 28, the final controlled fluid output line 40 to the output 30, and a fluid supply line 42 to the inlet 32. The ambient pressure line 34 may be opened to sea pressure (not shown), the line 42 may be connected to a fluid reservoir (not shown), the line 36 may be connected to the inlet of a pump (not shown), the line 38 may be connected to the outlet of the pump, and the line 40 may be connected to a fuel consuming device, such as a torpedo motor (not shown).

Valve means, which may include a bail 44 and a seat 46, are located within each passageway 14 and 16 between the bottom plenum 22 and the middle plenum 20. The valve means are responsive to pressure in the bottom plenum 22 for bypassing fluid from the bottom plenum to the middle plenum 20.

Figure 6:
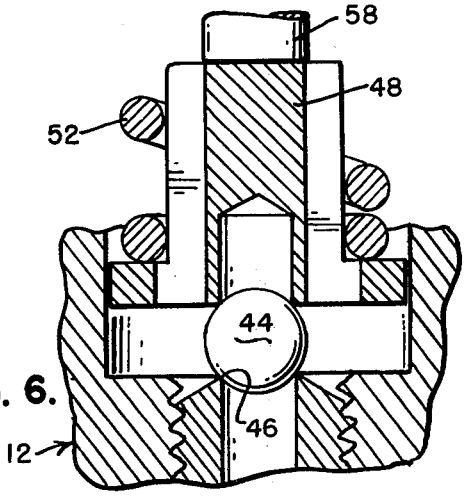
FIG. 6 is an enlarged detail view illustrating one of the two ball valves and ball guides utilized in the fluid control apparatus.
Figure 7:
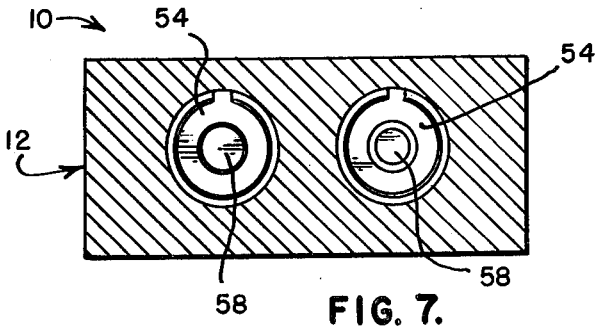
FIG. 7 is a cross sectional view taken along plane VII—VII of FIG. 4.

Spring biased means, responsive to the ambient pressure and the top plenum 18 and located at each passageway 14 and 16, for pushing each ball 44 of the bypass valve means toward the closed position against the pressure in the bottom plenum 22 will described hereinbelow. As illustrated in FIGS. 2 and 6, the spring biased ambient pressure responsive bypass valve pushing means in the high pressure passageway 14 may include a flanged valve guide 48 which is reciprocable in the passageway 14 and which bears directly on the top of the ball 44. The pushing means may further include a compression spring adjusting means, such as a tubular screw 50 which is adjustably threaded into the top portion of the high pressure passageway 14. Between the bottom of the screw 50 and the top of the flanged portion of the valve guide 48 is disposed a compression spring 52 for forcing the ball 44 in a downward closed position. The tubular screw 50 can be threaded to various positions in the valve body to adjust the pressure of the spring 52 on the top of the ball 44. The adjustment can then be locked in place by an anti-rotation washer 54 and a lock nut 56 which is also threaded in the passageway 14. The spring bias ambient pressure responsive bypass valve pushing means further includes a piston 58 which is slidably and sealably disposed within the tubular screw 50. The bottom portion of the piston 58 bears directly against the top of the valve guide 48, and the top of the piston is exposed to the ambient pressure within the top plenum 18. Accordingly, the ball 44 is subjected to two separate downward forces, namely: the force of the compression spring 52, and the force of the piston 58 caused by the ambient pressure in the top plenum 18. The spring biased ambient pressure responsive bypass valve pushing means in the low pressure passageway 16 is identical to such means described for the high pressure passageway 14 except for two very important differences. These important differences are that the spring 52 in the low pressure passageway 16 is applying a lesser downward force on the ball 44 in the low pressure passageway 16, and the piston 58 in the low pressure passageway 16 has a larger top area so as to be responsive to a greater degree to change of ambient pressure in the top plenum 18 than the piston 58 in the high pressure passageway 14. The importance of these differences will be described in the next paragraph.

Figure 3:
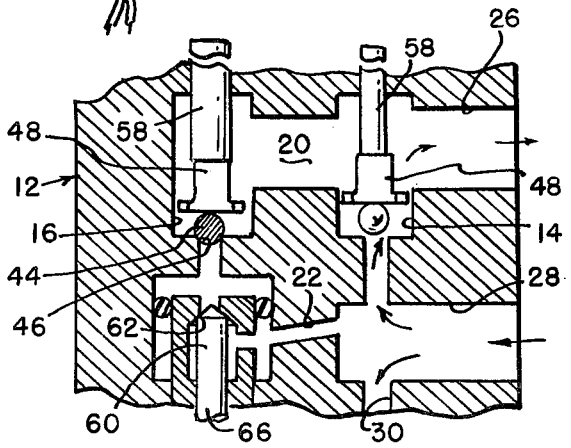
FIG. 3 is a schematic illustration of the operational mode of FIG. 2.
Figure 4:
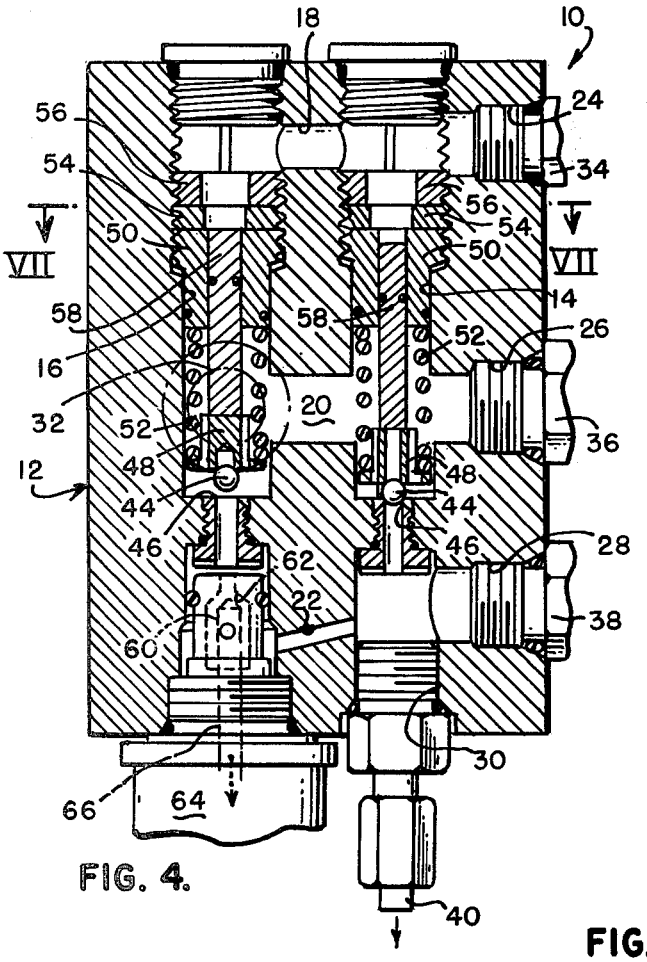
FIG. 4 is a view identical to FIG. 2 except the control apparatus is shown in a low speed mode of operation.
Figure 5:
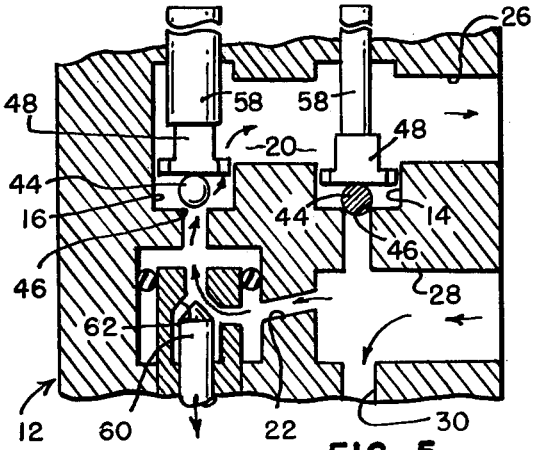
FIG. 5 is a schematic illustration of the low speed mode of operation of FIG. 4.

Control valve means, such as pintle 60 and valve seat 62, are provided for selectively opening and closing the bottom portion of the low pressure passageway 16 to the bottom plenum 22. The valve seat 62 may be integral or a threaded insert into the bottom portion of the low pressure passageway 16. The control valve means may further include a longitudinal solenoid 64 which has its actuating shaft 66 directly connected to the pintle 60. The solenoid 64 is operated by other equipment (not shown), such as guidance equipment in a torpedo. The solenoid 64 is capable of operating in two modes, namely: an extended position of the shaft 66 to close the pintle 60 against the valve seat 62 or a retracted position of the shaft 66 to open the pintle with respect to the valve seat 62. The closed position of the valve 60 is illustrated in FIGS. 2 and 3, and the open position of the valve 60 is illustrated in FIGS. 4 and 5.

OPERATION OF THE INVENTION

Figure 8:
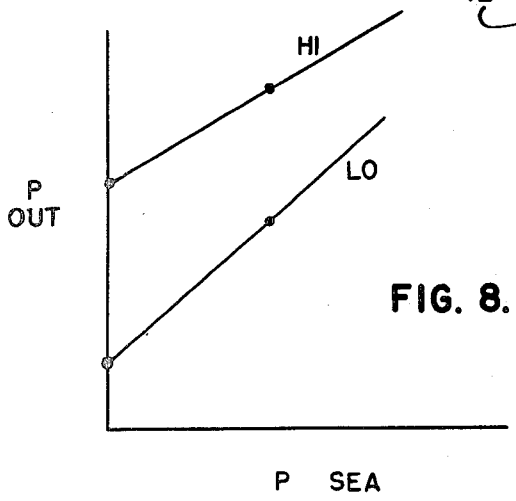
FIG. 8 is a chart illustrating the variance of fluid pressure output in both the low and high speed modes of operation as sea pressure increases.

As described hereinabove the spring 52 in the high pressure passageway 14 applies a stronger downward pressure to the ball valve 44 than the downward force of the spring 52 on the ball valve 44 in the low pressure passageway 16. This may be accomplished by either literally a stronger spring or proper adjustment of the tubular screws 50. The operational result of the stronger spring pressure in the high pressure passageway 14 is that the ball valve 44 in the low pressure passageway 16 will open to bypass fluid, such as fuel, from the lower plenum 22 to the middle plenum 20 while the ball valve 44 in the high pressure passageway 14 remains closed. This operation is illustrated in FIGS. 4 and 5. A different mode of operation occurs when the solenoid 64 closes the valve 60, thereby shutting off the low pressure passageway 16 to the lower plenum 22. This enables the ball valve 44 of the high pressure passageway 14 to then come into operation, as illustrated in FIGS. 2 and 3. The ball valves 44 in either passageway will operate only when the fuel pressure in the bottom plenum 22 exceeds the downward force due to spring pressure, ambient pressure, and fuel pressure in the middle plenum 20. When this occurs, fuel will be bypassed from the bottom plenum 22 into the middle plenum 20 so as to maintain a controlled regulated pressure of fuel exiting the apparatus 10 via the outlet line 40. This describes a broad concept of the present invention. However, in torpedo work it is necessary that the fuel pressure increase as the torpedo transcends to a greater depth in the ocean. This is accomplished by the operation of the pistons 58 in the high pressure and low pressure passageways 14 and 16 respectively. As the torpedo goes to a greater depth, the ambient sea pressure in the top plenum 18 exerts a greater downward pressure on the pistons 58 so as to combine with the downward force of the springs 52 to urge the ball valves 44 to a closed position. Additionally, it is important that the rate of increase of the downward force with increasing sea pressure be greater in the low pressure passageway 16 than that in the high pressure passageway 14 because of the characteristics of the torpedo motor. This has been accomplished by providing a larger piston 58 in the low pressure passageway 16 than that shown in the high pressure passageway 14. This relationship of output pressure from fuel line 40 with increasing sea pressure is illustrated in FIG. 8 where it is shown that the difference between the output pressures of the low pressure passageway and high pressure passageway operations decreases with increasing sea pressure. Accordingly, the fluid control apparatus 10 may be supplied with a fluid fuel via the line 42 into the middle plenum 20 where this fuel combined with any fuel bypassed by either of the passageways 14 and 16 is fed to a pump (not shown) via the line 36. The pump pressurizes the fuel and feeds it to the bottom plenum 22 via the line 38 where the fuel is in turn fed to a propulsion motor (not shown) via the outlet line 40. When the pressure within the bottom plenum 22 is above a predetermined amount, the fuel will be bypassed to the middle plenum 20 via the high pressure passageway 14 or the low pressure passageway 16 depending upon whether the valve 60 is closed or open. With this arrangement the fluid control apparatus 10 will supply high pressure fuel when the valve 60 is closed and will supply low pressure fuel when the valve means 60 is open, both of these pressures being dependent upon the magnitude of ambient sea pressure in the top plenum 18.

Obviously, many modifications and variations of the present invention are possible in the light of the above teachings, and, it is therefore understood that within the scope of the disclosed inventive concept, the invention may be practiced otherwise than as specifically described.

What is claimed is:

1. A dual speed fluid control apparatus comprising:

a valve body;

a high pressure passageway and a low pressure passageway extending vertically through the valve body in a spaced apart relationship;

a top portion of the passageways being interconnected by a top plenum, a middle portion of the passageways being interconnected by a middle plenum, and a bottom portion of the passageways being interconnected by a bottom plenum;

the valve body having: an ambient pressure inlet into the top plenum, a fluid bypass outlet into the middle plenum, and a pressurized fluid inlet and fluid outlet into the bottom plenum;

valve means located within each passageway and responsive to pressure in the bottom plenum for bypassing fluid from the bottom plenum to the middle plenum;

spring biased means responsive to the ambient pressure in the top plenum and located in each passageway for pushing each bypass valve means toward the closed position against the pressure in the bottom plenum;

the spring bias on the push means in the high pressure passageway being greater than the spring bias on the push means in the low pressure passageway; and control valve means for selectively opening and closing the bottom portion of the low pressure passageway to the bottom plenum, whereby the fluid control apparatus supplies high pressure fluid when the control valve means is closed and the fluid control apparatus supplies low pressure fluid when the control valve means is open, both flow rates being varied by the magnitude of ambient pressure in the top plenum.

2. A dual speed fluid control apparatus as claimed in claim 1 including:

the bypassing valve means and push means in the low pressure passageway being more responsive to ambient pressure increase than the bypassing valve means and push means in the high pressure passageway.

3. A dual speed fluid control apparatus as claimed in claim 2 including:

the push means in each passageway including a piston; and the piston in the low pressure passageway having a larger cross sectional top area than the cross sectional top area of the piston in the high pressure passageway.

4. A dual speed fluid control apparatus as claimed in claim 1 including:

the bypassing valve means being a ball and seat located in each passageway between the bottom and middle plenums.

5. A dual speed fluid control apparatus as claimed in claim 1 including:

the bypass valve pushing means having a piston and compression spring located in each passageway above the respective bypass valve means.

6. A dual speed fluid control apparatus as claimed in claim 5 including:

means for adjusting the compressive force of each compression spring.

7. A dual speed fluid control apparatus as claimed in claim 6 including:

the compression spring adjusting means being a tubular screw threaded into the top portion of each passageway above each respective spring; and each piston slidably and sealably extending through a respective tubular screw.

8. A dual speed fluid control apparatus as claimed in claim 1 including:

the control valve means including a solenoid for selectively opening and closing the control valve means.

9. A dual speed fluid control apparatus as claimed in claim 8 including:

the bypassing valve means and push means in the low pressure passageway being more responsive to ambient pressure increase than the bypassing valve means and push means in the high pressure passageway.

10. A dual speed fluid control apparatus as claimed in claim 9 including:

the push means in each passageway including a piston;

the piston in the low pressure passageway having a larger cross sectional top area than the cross sectional top area of the piston in the high pressure passageway.

11. A dual speed fluid control apparatus as claimed in claim 10 including:

the valve body having a fluid supply inlet into the middle plenum.

12. A dual speed fluid control apparatus comprising:

a valve body;

a high pressure passageway and a low pressure passageway extending vertically through the valve body in a spaced apart relationship;

upper and lower laterally extending plenums interconnecting upper and lower portions of the passageways;

the valve body having a fluid bypass outlet into the upper plenum and a pressurized fluid inlet and fluid outlet into the lower plenum;

valve means located within each passageway and responsive to pressure within the lower plenum for bypassing fluid from the lower plenum to the upper plenum;

biasing means located in each passageway for pushing each valve means toward the closed position against the pressure in the lower plenum;

the biasing means in the high pressure passageway being stronger than the biasing means in the low pressure passageway; and control valve means for selectively opening and closing the bottom portion of the low pressure passageway to the lower plenum whereby the fluid control apparatus supplies high pressure fluid when the control valve means is closed and the fluid control apparatus supplies low pressure fluid when the control valve means is open.

13. A dual speed fluid control apparatus as claimed in claim 12 including:

the control valve means including a solenoid for selectively opening and closing the control valve means.

* * * * *